US005739754A

United States Patent [19]

Schrott et al.

[11] Patent Number: 5,739,754

[45] Date of Patent: Apr. 14, 1998

[54] CIRCUIT ANTITHEFT AND DISABLING MECHANISM

[75] Inventors: Alejandro Gabriel Schrott, New York; Michael John Brady, Brewster; Thomas A. Cofino, Rye; Richard Joseph Gambino, Stony Brook; Robert Jacob Von Gutfeld, New York; Harley Kent Heinrich, Brewster; Paul Andrew Moskowitz, Yorktown Heights, all of N.Y.

[73] Assignee: International Business Machines Corporation, Armonk, N.Y.

[21] Appl. No.: 681,742

[22] Filed: Jul. 29, 1996

[51] Int. Cl.[6] ..... G08B 13/14

[52] U.S. Cl. ..... 340/572; 340/551

[58] Field of Search ..... 340/572, 551, 340/825.34, 825.54; 235/439, 488, 493, 230; 324/306, 309, 320, 224

[56] References Cited

U.S. PATENT DOCUMENTS

| | | | |
|---|---|---|---|
| 3,665,449 | 5/1972 | Elder et al. | 340/572 |
| 3,978,998 | 9/1976 | Kiltz | 214/132 |
| 4,215,342 | 7/1980 | Horowitz | 340/572 |
| 4,539,558 | 9/1985 | Fearon | 340/572 |
| 4,542,361 | 9/1985 | Cavanagh | 335/230 |
| 4,950,988 | 8/1990 | Garshelis | 324/207.24 |
| 4,992,776 | 2/1991 | Crossfield | 340/572 |
| 4,999,609 | 3/1991 | Crossfield | 340/572 |
| 5,235,326 | 8/1993 | Beigel et al. | 340/572 |
| 5,349,329 | 9/1994 | Smith | 340/539 |
| 5,559,507 | 9/1996 | Beigel | 340/572 |

*Primary Examiner*—Brent A. Swarthout
*Assistant Examiner*—Van T. Trieu
*Attorney, Agent, or Firm*—Louis J. Percello

[57] ABSTRACT

The present invention is a magnetic sensor used with one or more frequency band pass filters and a logic circuit that produces a ("critical") signal that is used for enabling and disabling an external electronic circuit, e.g. a computer circuit. The magnetic sensor produces a signal when excited by an externally applied alternating current (ac) magnetic field. The external ac magnetic field can comprise one or more frequencies, each of which induces an electrical signal at the respective frequency in the sensor. Depending on the linearity of the sensor, one or more harmonic frequencies of the signal frequencies can also be induced in the sensor. One or more bandpass filters is connected to the magnetic sensor and each of the bandpass filters is tuned to filter the signal to select filtered signals, from the output of the sensor. A logic circuit is activated by one or more of the filtered signals or a combination of one or more of the signal frequencies. When the logic circuit is activated, a critical signal is applied to an electronic circuit to enable or disable the external electronic circuit.

12 Claims, 8 Drawing Sheets

REDUCED CHARACTERISTIC TABLE FOR THE GRATED S–R LATCHES

| C | S | R | Q | OPERATION |
|---|---|---|---|---|
| 0 | 0 | 0 | $Q_0$ | NO CHANGE |
| 0 | 0 | 1 | $Q_0$ | NO CHANGE |
| 0 | 1 | 0 | $Q_0$ | NO CHANGE |
| 0 | 1 | 1 | $Q_0$ | NO CHANGE |
| 1 | 0 | 0 | $Q_0$ | NO CHANGE |
| 1 | 0 | 1 | 0 | RESET |
| 1 | 1 | 0 | 1 | SET |
| 1 | 1 | 1 | 0.1 | RESET (S–R NOR), SET (S–R NAND) |

404
Q
406
$\overline{Q}$
S
C
R
404
416
206
Q
$\overline{Q}$
205
S
C
R
203
OR
204
AND
403
AND
$f_4$
401
$f_5$
402
203
$f_1$
201
$f_2$
212
$f_3$
213

CIRCUIT ANTITHEFT AND DISABLING MECHANISM

FIELD OF THE INVENTION

The invention relates to the field of radio frequency, magnetic, and acoustic tagging. More specifically, the invention relates to using a tag to disable/enable an electrical circuit, especially for theft prevention.

BACKGROUND OF THE INVENTION

Radio Frequency (RF) identification or tagging (RFID) systems typically use a base station radio transceiver to communicate with a tag (transponder) on an object. There are many uses for these RFID systems. See U.S. Pat. No. 4,656,463 by Anders et al. issued on Apr. 7, 1987 which is herein incorporated by reference in its entirety.

One use of RF tagging (RFID) systems is to prevent theft in the retail industry, e.g. the sale of electronic equipment. It is estimated that retailers and manufacturers lose at least one per cent of their sales every year due to theft or 'shrinkage'. The current approach to this problem is to place either an electronic article surveillance (EAS) tag, or an RF identification tag onto the item. Generally, these systems rely on either: 1. detecting the presence of a tag on an item within the proximity (RF field or field) of the base station or 2. communicating information to and/or from the tag, e.g. identity, object description, etc. Both of these systems rely on the ability of the reader to detect a tag as it leaves a designated area (base station field) and are only able to activate an alarm when a stolen item is detected. However, if a thief can pass the item through the base station field undetected, e.g. by shielding the tag from the base station RF signals, the prior art systems offer no deterrent to the theft.

The prior art has addressed the notion of remotely enabling and/or disabling a circuit with radio frequency transponders. Philips Corp. has disclosed a vehicle immobilization technology that only permits a vehicle motor to start when a changeable code is passed from a tag in an ignition key to a circuit that is connected to the vehicle engine. The tag is not electrically connected to the circuit. In this technology, a complex tag reader is needed for each engine circuit that is to be enabled/disabled. The relatively simple tag in the key has to be in a specific proximity (location) with respect to the tag reader in order for the reader to access the code on the tag. Further, the tag reader will require power from some source associated with the enabled/disabled circuit. Because of the complexity, expense, and power requirements of the tag reader, this system is limited to enable/disable expensive circuits with on board power.

STATEMENT OF PROBLEMS WITH PRIOR ART

There is a need for an effective and inexpensive device that prevents or inhibits theft of electronic circuitry, especially computer circuits. There is also a need for this device to perform its function in an environment that shields radio frequency signals.

OBJECT OF THE INVENTION

An object of this invention is a system and method for preventing or inhibiting theft of electronic circuits, particularly computer circuits.

Another object of this invention is a system and method that uses a standard and inexpensive tag that enables/disables an electronic circuit in order to prevent or inhibit the theft of the electronic circuit.

Another object of this invention is a system and method for preventing or inhibiting theft of electronic circuits when the electronic circuits are in an environment that is shielded from radio frequency signals.

SUMMARY OF THE INVENTION

The present invention is a magnetic sensor used with one or more frequency bandpass filters and a logic circuit that produces a ("critical") signal that is used for enabling and disabling an external electronic circuit, e.g. a computer circuit. The magnetic sensor produces a signal when excited by an externally applied alternating current (ac) magnetic field. The external ac magnetic field can comprise one or more frequencies, each of which induces an electrical signal at the respective frequency in the sensor. Depending on the linearity of the sensor, one or more harmonic frequencies of the signal frequencies can also be induced in the sensor. One or more bandpass filters are connected to the magnetic sensor and each of the bandpass filters is tuned to filter the signal to select signals, called filtered signals, from the output of the sensor. A logic circuit is activated by one or more of the filtered signals or a combination of one or more of the signal frequencies. When the logic circuit is activated, a critical signal is applied to an electronic circuit to enable or disable the external electronic circuit. Variations of the logic circuit permit the external electronic circuit be enabled if disabled and cause the disabling function to be bypassed.

To produce a critical signal, the magnetic sensors used need only communicate with a sensor mounted in close proximity within the same package in which the coil is mounted.

Various alternative embodiments of magnetic sensors are disclosed, including one that uses a commercially available magnetic tagging device. The magnetic tagging device is capable of communicating with a remote base station (gate) while also providing a signal to the coil.

DESCRIPTIONS OF THE DRAWINGS

Figure 6A:
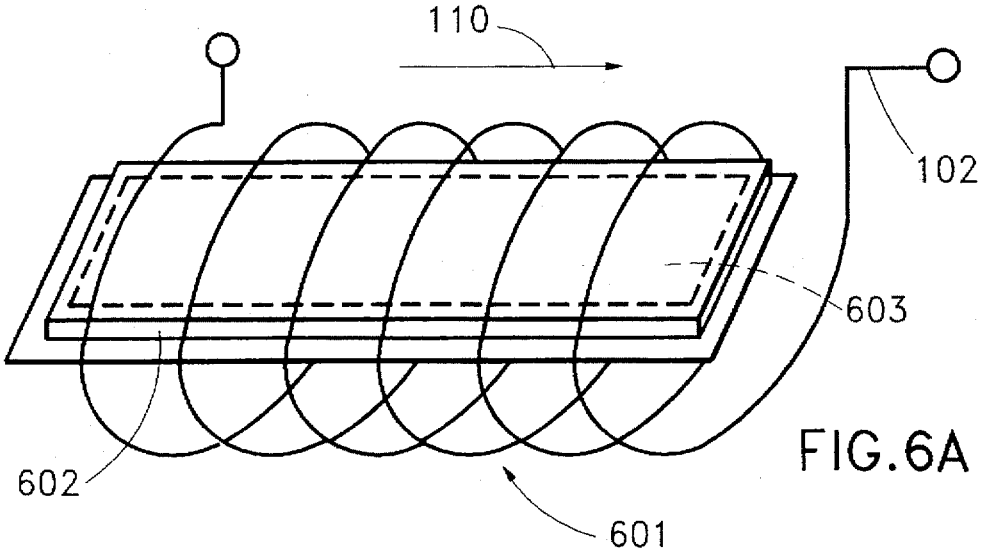
Figure 6B:
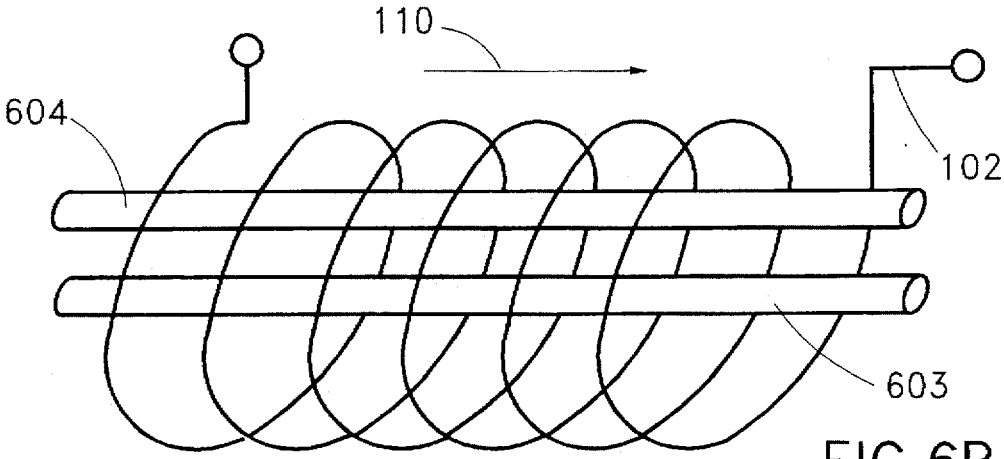
Figure 6C:
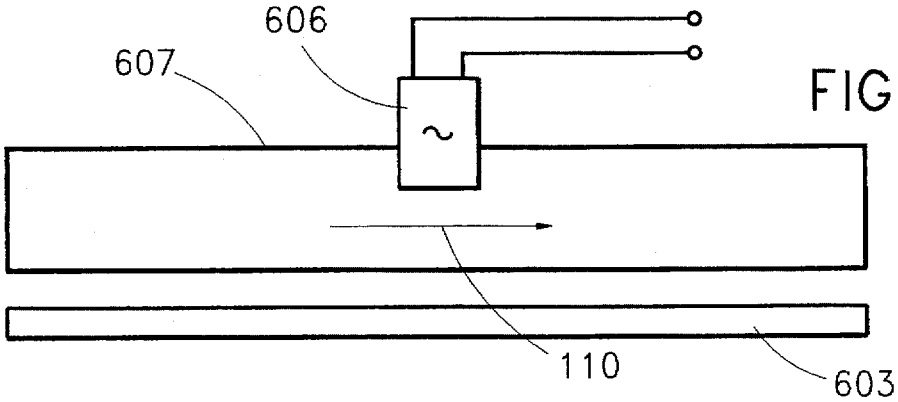

FIGS. 6A–C are block diagrams of different commercially available tags using the invention to act as the magnetic sensor and to produce a magnetic field that is locally detected to activate/deactivate the external circuit and simultaneously to sound a remote alarm.

Figure 7A:
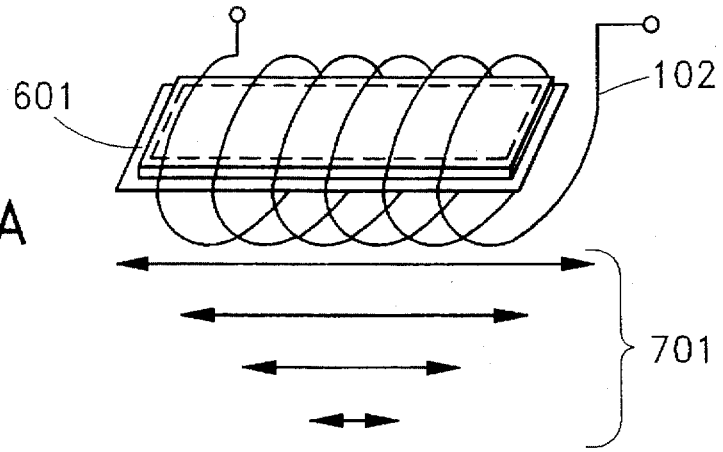
Figure 7B:
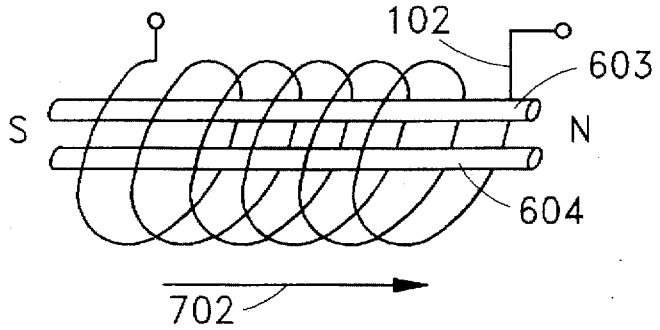
Figure 7C:
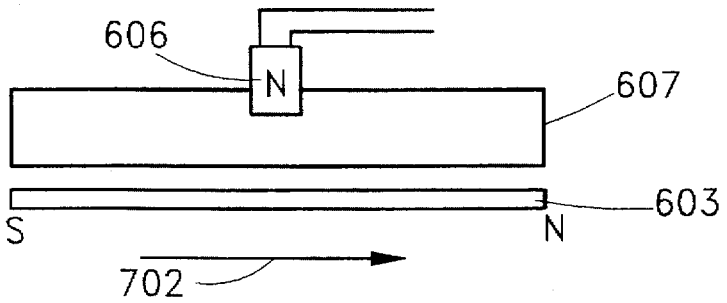

FIGS. 7A–C shows means for deactivating the tags shown in FIGS. 6A–C by using a magnetic dc bias field.

Figure 7D:
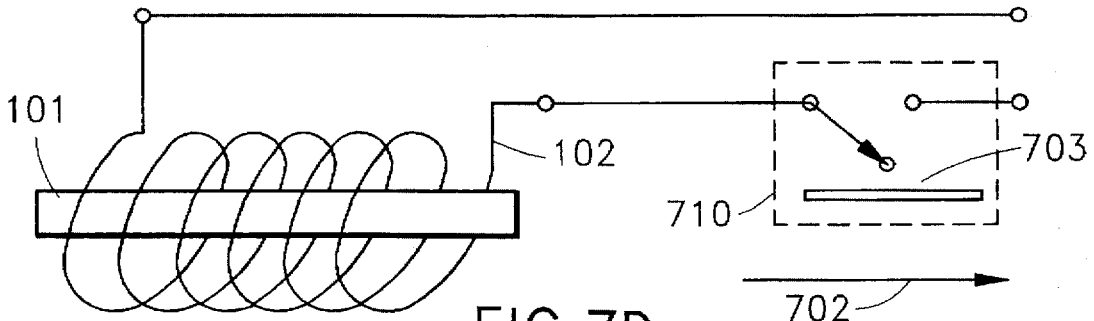

FIG. 7D shows means for deactivating the tags by means of a magnetic switch.

DETAILED DESCRIPTION OF THE INVENTION

Figure 1:
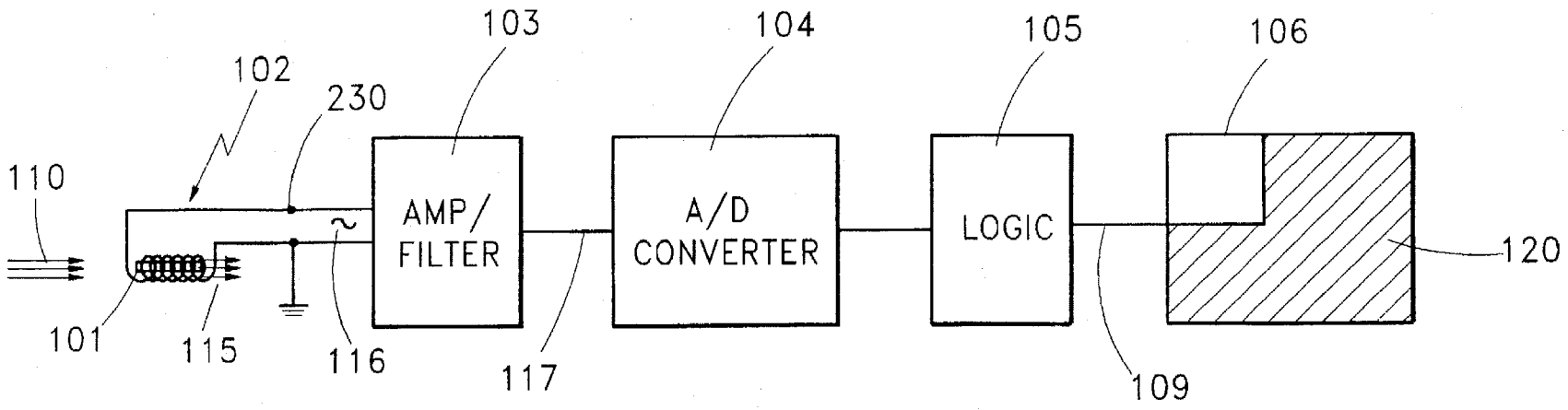
FIG. 1 is a block diagram of a magnetic sensor and the accompanying local detection circuit for disabling an external electronic (e.g., computer) circuit.

As shown in FIG. 1, the invention uses a magnetic sensor, in one preferred embodiment, comprising a pickup coil 102 and a soft magnetic material 101 which is the core of the pickup coil 102. Because of the core's large permeability, typically at least several hundred times and more typically several thousand times as large as that of air, the externally applied ac magnetic field 110 will result in a large magnetic flux 115A (due to the magnetic field 115), rich in harmonics of the applied fundamental frequency, through the pickup coil 102, emanating from the core 101. The sensing of this flux results in a voltage 116 produced in the pickup coil 102 which can be amplified and filtered in an amplifier/filter circuit 103 to select a distinct predetermined frequency. The filtered signal 117 can be converted to a logic signal in the a/d converter unit 104 used to activate a logic circuit 105 which generates a critical signal 109 acting on a critical circuit element 106 of the computer or the electronic device (external circuit) 120 causing it to be disabled.

Magnetic field 115 is a result of the ac field 110 which causes a magnetization to be induced in the core 101 which is non-linear in its response to the field 110, hence producing harmonics of the frequency of field 110. Thus field 115 need only communicate with a sensor mounted in close proximity within the same package in which 102 is mounted. Thus, shielding problems are much less severe than those typically occurring for embedded 1 bit magnetic sensors. In that case, the fields produced by the sensor must be communicated back to a base station in order to be effective in theft detection.

For a description of critical part 106, external circuit 120, and the connections to the critical part 106 that enable/disable the external circuit 120, refer to U.S. patent application No. (docket number YO996-037 assigned to IBM) entitled "Radio Frequency Identification Transponder with Electronic Circuit Enabling/Disabling Capability to Capek et al. which is filed on the same day as this application and is herein incorporated by reference in its entirety.

Figures 2A, 2B:
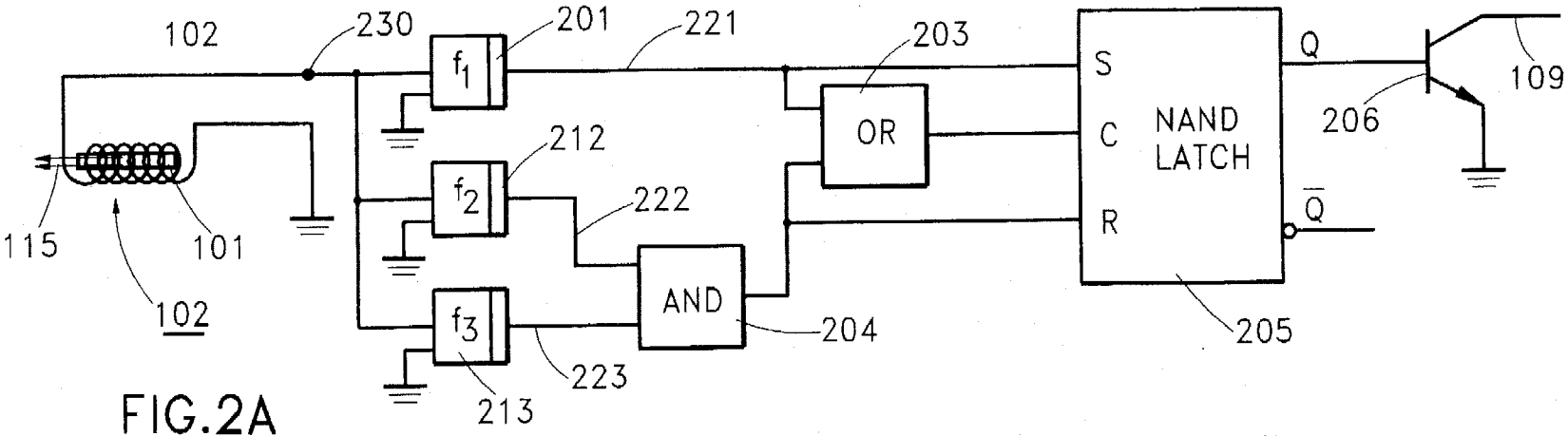
FIG.2B PRIOR ART
FIGS. 2A and 2B depict a circuit diagram (FIG. 2A) that shows a preferred logic circuit (and circuit logic states—FIG. 2B) for disabling and enabling the external circuit computer.

FIG. 2A shows an alternative embodiment, where there is more than one amplifier/filter 103 and comparator/rectifier 104 components, assembled into modules hereafter called signal sensors, typically 201, 212, and 213. Each of these signal sensors is capable of detecting a signal at a given frequency and producing a logic output used by the logic devices 203,204, and 205, respectively. These signal sensors contain band pass filters, amplifiers, and comparators and can be assembled from standard components that are well known. Therefore the respective logic devices (203, 204, and 205) receive a signal if the signal sensors (201,212, 213) pass their tuned frequency, i.e., the fundamental frequency or any of the harmonics of the fundamental frequency produced by the coil 101.

Note that in this embodiment, the filters are tuned to frequencies that are not integrally related. One or more signal sensors 201, are tuned to a first frequency or one of the harmonics of this first frequency. However, a second set of one or more second signal sensors (e.g., either 204 or 205) are not tuned to the first frequency or any one of the harmonics of this first frequency. Instead, each of the signal sensors in the second set is tuned to a frequency of the second set or one of the harmonics of each frequency of the second set. In a similar manner, there can be other signal sensors tuned to a third frequency or any harmonic of the third frequency, etc.

Figure 3A:
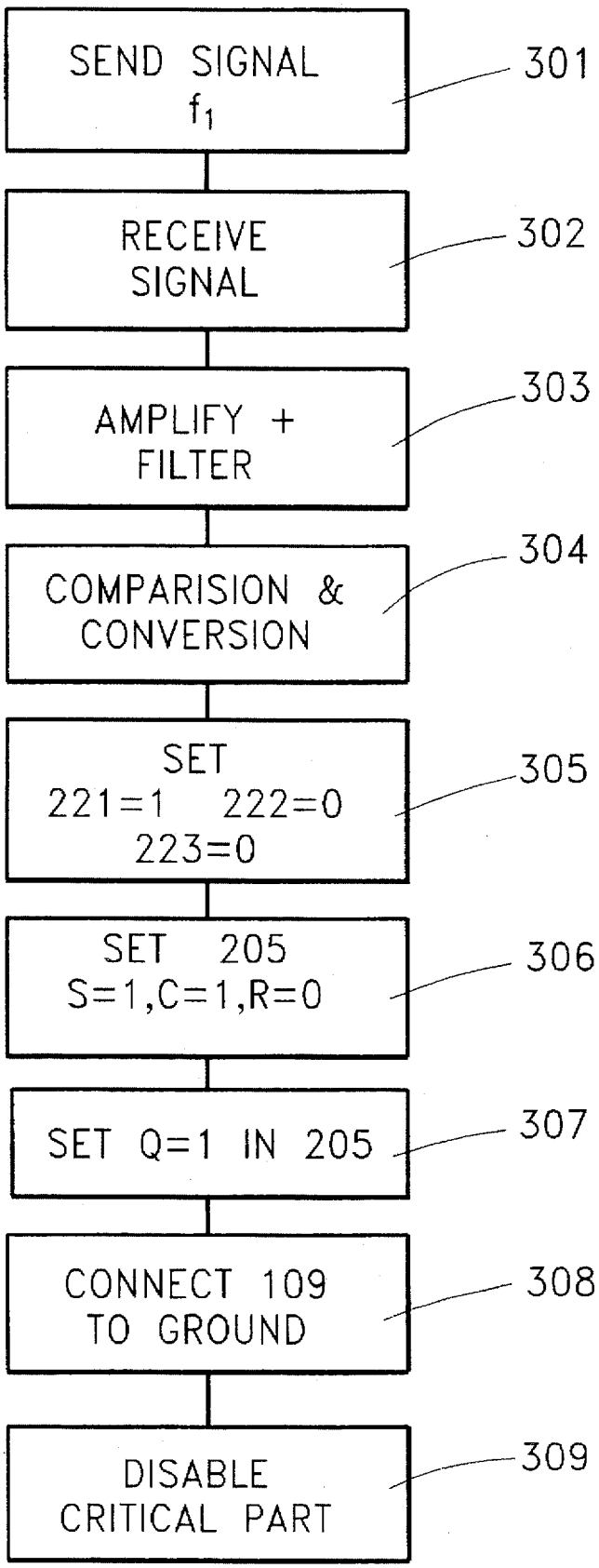
FIG. 3A is a flow chart of a sequence of events leading to disabling the external circuit.
Figure 3B:
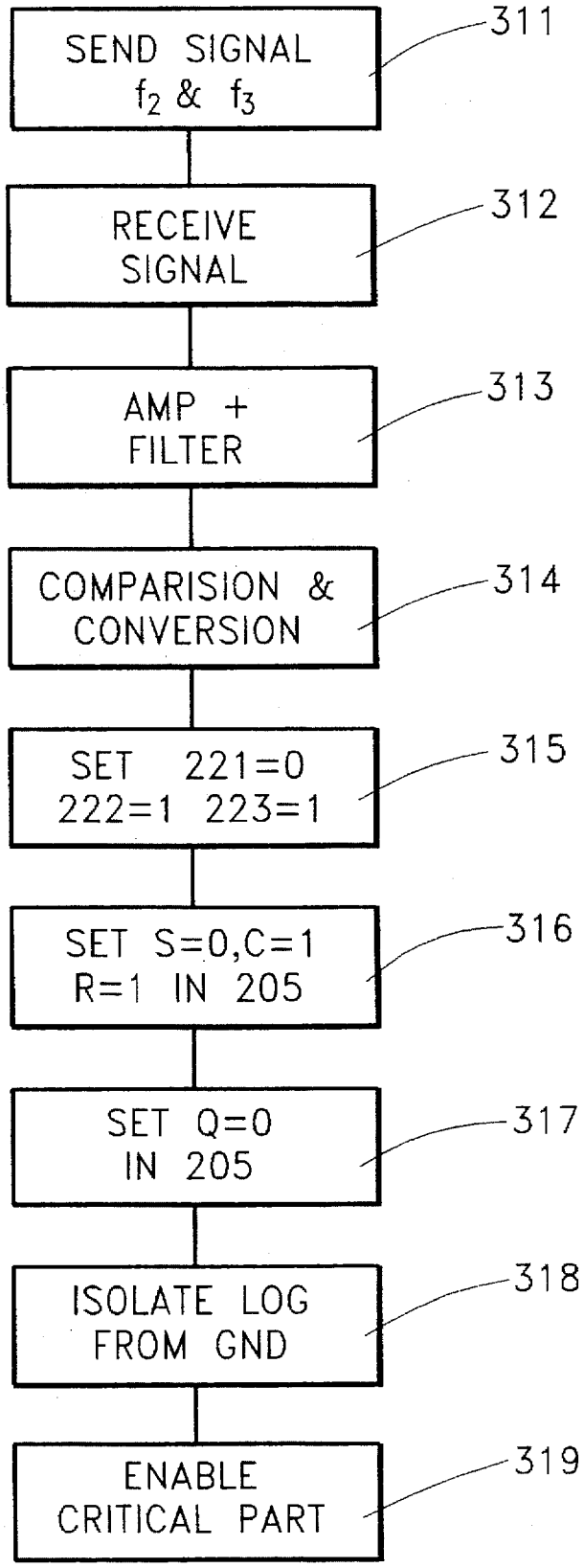
FIG. 3B is a flow chart of process steps leading to the reactivation or reenablement of the external circuit after prior disablement.

A typical disabling/enabling logic circuit is shown in FIG. 2A and a flow chart of the disabling steps is shown in FIG. 3A. A non limiting example is shown in FIG. 2A using a well known NAND gate with characteristics shown in FIG. 2B. Refer also to FIG. 3B.

When the applied magnetic field 110 containing only the fundamental frequency $f_1$ is sent 301, the magnetic field induces magnetization that results in a relatively large, harmonically rich flux 115A sensed 302 by coil element 102. The harmonics are created by the non linear permeability of the core 101 as described by the hysteresis curve of the core. Therefore, a current is induced in the coil 102 that is also rich in harmonics containing not only the fundamental frequency, $f_1$ but also the set of frequencies $f_{1i}$. harmonically related to $f_1$. The signal 116 is amplified, filtered, compared, and converted to a logic signal 221.

The logic signal 221 consisting of either a '1' or '0' is applied 305 to point 'S' of the 'S-R NAND' latch 205 and to the input of the 'OR' gate 203. If signal 221 corresponds to a '1' logic bit, indicating the presence of a signal with a given frequency e.g., the fundamental $f_1$, this input sets 306 the points 'S', 'C'. 'R' in 205 to '1', '1', and '0' respectively. In this case the signals 222 and 223 are null because the ac magnetic field 110 does not cause the core 102 to produce the frequencies $f_2$ and $f_3$, which belong to the second set of frequencies, and are not harmonically related (integral multiples) of $f_1$. Since the signal 110 does not contain the frequencies, $f_2$ and $f_3$, 'R' is set to '0' because the inputs 222 and 223 to the AND gate 204 are zero.

Therefore the output 'Q' in 205 will be set 307 with a value '1' applied to the base of the transistor 206 or to any device with a similar function. The last step 307 produces a conducting path between collector and emitter in the transistor 206 connecting 308 line 119 to ground. The grounding of line 119 disables 309, the critical part 106 of the computer or electronic device 120.

Note that FIG. 2B shows the characteristic table of a typical prior art NAND latch 205. For a discussion of NAND latches 205 and other logic circuits see *Modern Digital Designs* by R. S. Sandige, published by McGraw Hill, 1990, which is herein incorporated by reference in its entirety.

To re-enable the disabled computer or electronic device 120, the signal 110 must provide a set of one or more (preferably two or more) second frequencies, applied simultaneously, that are not harmonically related (integral multiples) of the first frequency, $f_1$. The set of second frequencies, for example $f_2$ and $f_3$, are also not harmonically related, i.e., are not harmonics of one another. For example see step 311 in the flow chart, FIG. 3B. In one preferred embodiment, these second frequencies can be applied by a hand held source. In this embodiment, the signal 116 will have not only the fundamental second frequency(ies) but also the respective harmonic frequency components $f_{2i}$ and $f_{3i}$ which will be received 312, amplified and filtered 313 and compared to a reference and converted to the logic signals (step 314) by the signal sensors 212 and 213. (In a preferred embodiment the signal sensors 212 and 213 are tuned to the fundamental frequencies $f_2$ and $f_3$ respectively). These steps set 315 logical '1's in 222 and 223 which are the inputs to the AND logic gate 204. The AND gate 204 then sets 316, the input at 'S', 'C', 'R' to value of '0', '1', '1' respectively. According to FIG. 2B, this sets 317 the output 'Q' of 205 to a logical '0' and thus establishes 318, a high resistance path between emitter and collector of 206 leaving line 119 floating and reenabling 319, the critical part 106 of the computer. Additional frequencies can be added to the signal 110 to make it more difficult to tamper or to break the re-enabling code. Each additional frequency will require an additional AND gate 204 to create the final logic input at point 'R' in device 205.

Figure 4:
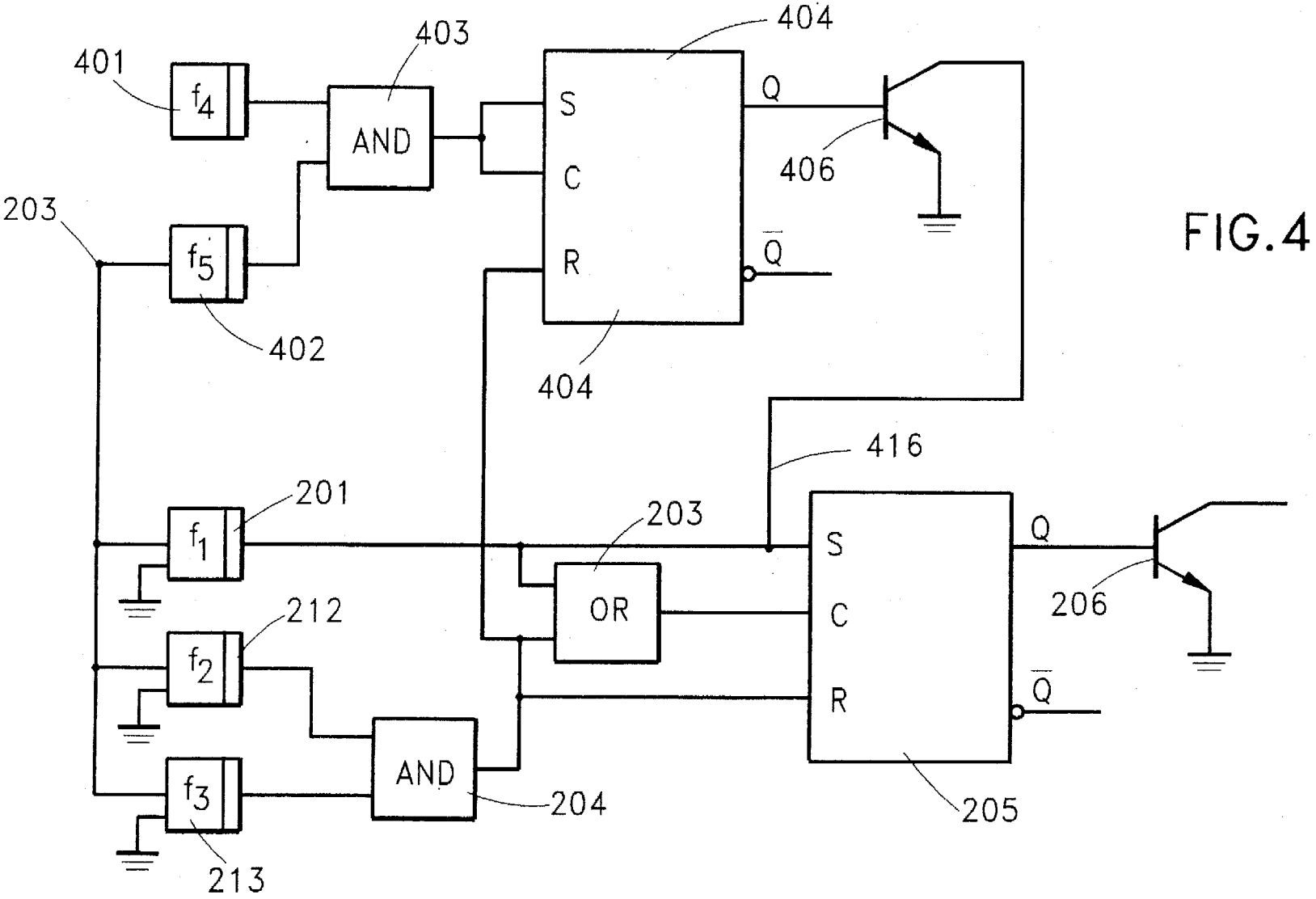
FIG. 4 is a circuit diagram for deactivating the magnetic sensor to prevent disablement of the computer by utilizing an external ac magnetic field.
Figure 5A:
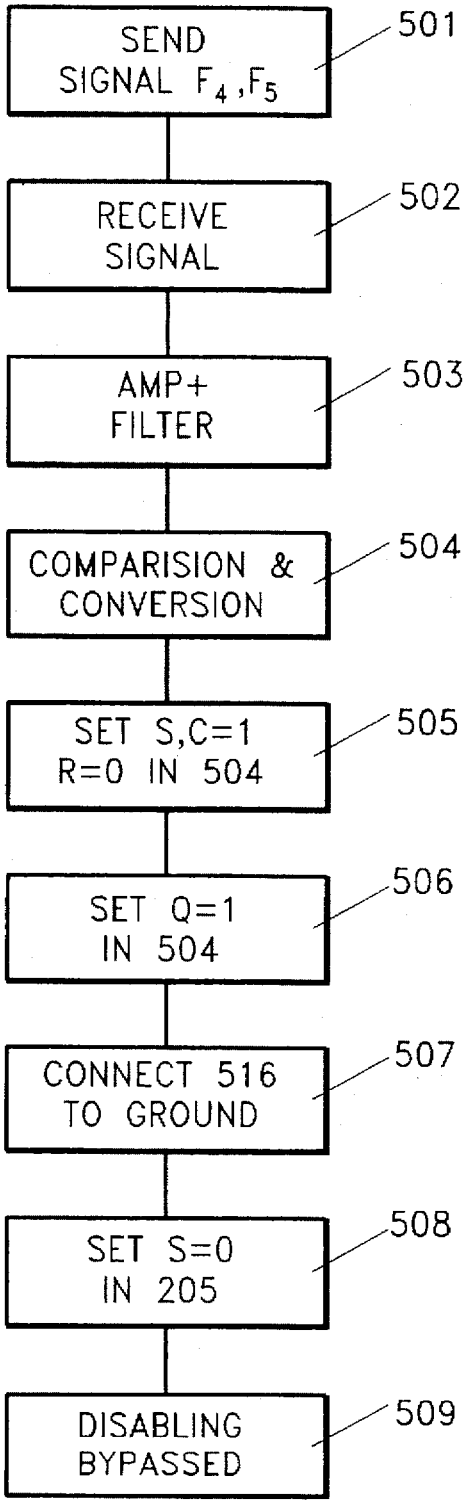
FIG. 5A shows a flow chart leading to the by-passing of the disabling mechanism.

Additional circuitry can be added to the logic 105 to make it possible to bypass the disabling mechanism so that the computer or electronic device can be moved past the disabling gate without disabling the device. This may be practical in an office where a computer can be authorized for overnight removal by a manager or an appropriate office personnel. In that case a circuit, like that shown in FIG. 4, is used. The flow chart for the bypassing steps is shown in FIG. 5A. To bypass the disabling circuit, the signal 110 now contains only two or more deactivating (also called bypassing frequencies)) frequencies, e.g., $f_4$ and $f_5$ 501, that are not harmonically related to either the first frequency or the second set of frequencies. Again, the received signal 502 will be amplified and filtered 503, compared to a reference, and converted to the logic signal (step 504) to set 505 the inputs of the AND logic gate 403 to be logical '1's. As a consequence, the output of 403 is used to set 505 the points 'S' and 'C' in the S-R NOR latch 404 to a logical '1'.

Since the signal 110 contains neither $f_2$ nor $f_3$, the output of 204 is a logical '0' and the signal at the point 'R' in 404 is a logical '0'. This sets 506, the output 'Q' in 404 equal to '1', see FIG. 2B, connecting 507 the collector and emitter in transistor 406, grounding the point 416, resulting 508 in a '0' at point 'S' of the device 205, regardless of the presence of $f_1$, leading, according to FIG. 2B, to a '0' in the output point 'Q' of 205 and therefore leaving line 119 floating irrespective of the presence of $f_1$, that is ungrounded, bypassing 509 the disabler circuit 105.

Figure 5B:
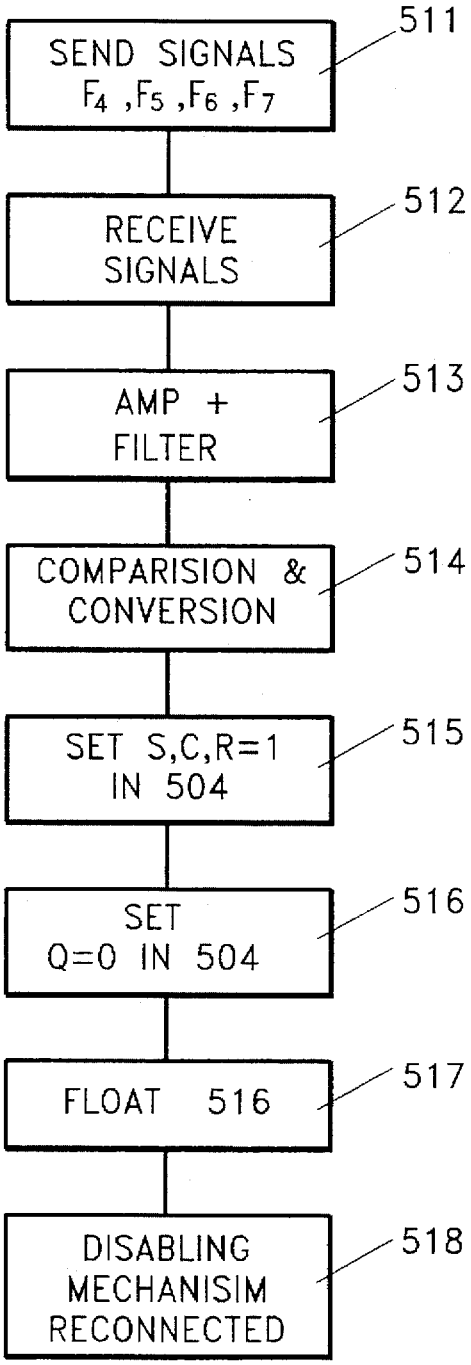
FIG. 5B shows a flow chart leading to reactivating the disabling mechanism.

The flow chart FIG. 5B shows the steps leading to a reactivation of the disabling circuit 105 once the bypass set of steps has been invoked as shown in the flow chart FIG. 5A. Here, the signal 110 contains the second frequencies $f_2$, $f_3$ and all the deactivating frequencies, e.g. $f_4$ and $f_5$ 511. The received signal 512 is amplified and filtered 513, compared to a reference, and converted to a logic signal (step 514) so that the points 'S' 'C' and 'R' in 404 will be set 515 to '1's. According to FIG. 4B, this set of logical '1's sets 516 'Q' equal to '0' in the 'S-R' NOR latch 404. Therefore, a high resistance path is established between the collector and emitter of the transistor 416 allowing point 'S' in 205 to float 517 thereby reactivating 518 the disabling circuit 105.

Other means to re-enable a disabled computer or to bypass the disabling circuit 105 could be accomplished through keyboard commands according to a secret code known only to appropriately designated personnel. By keying in commands in the secret code logic inputs bypass the signal sensors 212 and 213 and place logic signals directly on lines 222 and 223. Alternatively, a set of electrical signals can be directly applied to the inputs of the signal sensors (212 and 213) with a frequency to which the respective signal sensors are tuned.

It can be very desirable to trigger the disabling mechanism 105 by using commercially available anti theft tags as the source of the magnetic field 115. Moreover, it also desirable that the signal 115, the field produced by the element 101, has the capability of triggering the alarm of the gate. A simple method for achieving these two goals is to use a commercially available magnetic tag for the element 101. In this way the entire tag will operate as an antitheft device, where the soft magnetic element receives and sends back a signal to a remote external gate, while the same signal is sensed locally by the sensing coil 102.

FIG. 6A shows an embodiment where the element 101 has been replaced by an acousto-magnetic tag 601 (as described in the U.S. Pat. Nos. 4,510,489 and 4,510,490, assigned to Allied Corp. or more specifically in EP 0 592 780 A2, assigned to Sensormatic) where the soft magnetic material 602 is loosely encapsulated and therefore free to vibrate as a result of magneto elastic coupling. The soft magnetic material 602 is in close proximity to a strip of hard magnetic material serving as a magnetic bias 603.

FIG. 6B shows an embodiment where the element 101 consists of a piece of soft magnetic material in the shape of a wire or a thin strip 604 accompanied by an adjacent piece of a magnetic material 603 of high coercivity. This embodiment is similar to tags that make use of the harmonic content of strips or wire of soft magnetic material undergoing a hysteresis loop as a result of external ac field excitation 110 (as described by U.S. Pat. No. 4,581,524 assigned to Minnesota Mining and Manufacturing Co. or to U.S. Pat. No. 4,660,025, assigned to Sensormatic).

FIG. 6C describes an embodiment where the functions of the coil 102 and the element 101 are produced by a magnetic wire capable of exhibiting the Matteucci effect, (see "Mechanism of Matteucci Effect Using Amorphous Magnetic Wires" by K. Kawashima, T. Kohzawa, M. Takagi, K. Mohri, M. Kanoch, and L. V. Panina, IEEE Translation Journal on Magnetics in Japan, Vol 8, No 5, May 1993, P. 318) The Matteucci effect produces a voltage pulse 606 that can be sensed along the wire 607 and results from the wire being in the presence of an ac magnetic field 110.

The U.S. Pat. Nos. 4,510,489, 4,510,490, 4,581,524, and 4,660,025; the European Patent EP 0 592 780 A2; the IEEE Translation Journal on Magnetics; and the US Patent Applications entitled Concealed Magnetic ID Code and Antitheft Tag, docket number YO996-084 to Schrott et al. and A System for Concealed Serialization Utilizing a Soft Magnetic Antitheft Element, docket number YO996-085 to Schrott et al. are all herein incorporated by reference in their entirety.

The embodiment shown in FIG. 6C also shows a hard magnetic element 603 that can be used to disable the tag. The method for disabling these tags depends on their particular construction. For example, to disable the tag of FIG. 6A requires the use of a decrementing ac magnetic field 701 to demagnetize the element 603 as shown in FIG. 7A. The wire or strip 604 shown in FIG. 6B becomes inactive when the soft magnetic element 604 is saturated. This is accomplished by setting the hard magnetic element 603 into saturation by applying an external dc field of sufficient magnitude 702 and then withdrawing the external field 702, leaving the hard magnet in its remanent state, as shown in FIG. 7B. Similarly, the field 702 can be used to leave the hard element 603 in its remanent state to disable the wire 607 by preventing it from producing a voltage pulse, as shown in FIG. 7C.

An additional method of rendering the disabling mechanism into an inactive state is by interrupting the conducting path between the sensing coil 102 and the filter array 103. This can be accomplished by the use of a magnetic switch 710 as shown in FIG. 7D. Here a magnetic switch opens and leaves open a conducting path upon application of a dc magnetic field to provide the interruption in the conducting path of the sensing coil 102. Demagnetizing the magnetic switch 710 using a decrementing ac magnetic field 701 closes the circuit thereby reactivating the sensing coil 102.

In some embodiments, a metallic enclosure, e.g., aluminum foil, does not shield the ac magnetic field because the frequencies of the field are typically lower than 100 kilohertz. At these frequencies the magnetic field has a larger skin depth than the skin depth produced by radio frequency signals typically used. (Note that the skin depth is inversely proportional to the square root of the frequency. The lower the skin depth, the greater the shielding.) Other frequencies of the magnetic field are possible, if they are required by using a commercially available tag as element 101.

Given this disclosure, other equivalent embodiments of this invention contemplated by the inventors would become apparent to one skilled in the art.

We claim:

1. A system for enabling and disabling an electronic circuit comprising:

a. a magnetic sensor that produces a signal when excited by one or more externally applied alternating current (ac) magnetic fields, each magnetic field having a respective frequency, and the signal being an electrical signal that includes the frequency and zero or more harmonics of the frequency;

b. one or more signal sensors, electrically connected to the magnetic sensor, each of the signal sensors filtering the signal to select a respective filtered signal, comparing the filtered signal to a reference, and converting the compared signal to a logic signal; and c. a logic circuit activated by one or more of the logic signals and sending a critical signal to the electronic circuit when the logic circuit is activated, the logic circuit having a disabling function that disables the electronic circuit when the magnetic sensor is excited by a first externally applied ac magnetic field with a first set of at least one first frequency that activates the logic circuit and where the disabling function is bypassed when the magnetic sensor is excited by a third externally applied ac magnetic field with a third set of at least two bypassing frequencies, the bypassing frequencies not being harmonics of one another, and the bypassing frequencies further not being harmonics of the first frequency.

2. A system, as in claim 1, where the electronic circuit is enabled when the magnetic sensor is excited by a second externally applied ac magnetic field with second set of at least one second frequency, the second frequencies not being harmonics of one another.

3. A system, as in claim 1, where the bypassed disabling function is re-enabled when the magnetic sensor is simultaneously excited by a second set of frequencies and the third set of frequencies.

4. A system, as in claim 1, where the sensor is a coil with a core with a high permeability.

5. A system, as in claim 4, where the permeability is at least 100 times greater than that of air.

6. A system, as in claim 4, where the sensor is a coil and the core is an acousto-magnetic tag.

7. A system, as in claim 1, where the sensor is a coil and the core is a piece of soft magnetic material with an adjacent hard magnet.

8. A system, as in claim 7, where the soft magnetic material is a wire.

9. A system, as in claim 1, where the sensor is a magnetic wire that exhibits the Matteucci effect.

10. A system, as in claim 1, where the sensor is connected to the bandpass filter through a magnetic switch.

11. A method for disabling and enabling an external electronic circuit comprising the steps of:

inducing one or more first frequencies in a sensor;

filtering one or more of the first frequencies to create a first logic signal; setting a disable logic circuit with first logic signal to create a critical signal that disables the electronic circuit;

inducing, in the sensors two or more second frequencies that are not harmonically related to one another and are not harmonically related to the first frequency;

filtering one or more of each of the second frequencies to create one or more second filtered signals; and setting the logic circuit with one or more of the second filtered signals to create a critical signal that enables the external electronic circuit.

12. A method for bypassing a disabling circuit capable of disabling an external electronic circuit, comprising the steps of:

inducing two or more bypass frequencies in a sensor, the bypass frequencies not harmonically related to one another;

filtering one or more of the bypass frequencies to create a bypass logic signal;

setting a logic circuit with one or more of the bypass logic signals to bypass a disabling logic;

simultaneously inducing, in the sensor, two or more second frequencies that are not harmonically related to one another and are not harmonically related to the bypass frequencies;

filtering one or more of each of the second frequencies to create one or more second filtered signals; and setting the logic circuit with one or more of the second filtered signals so that the logic circuit does not by-pass the disabling logic.

* * * * *